United States Patent [19]

Brandby

[11] 3,939,784

[45] Feb. 24, 1976

[54] FUEL CONDUIT

[75] Inventor: Kenneth Brandby, Akron, Ohio

[73] Assignee: The Babcock & Wilcox Company, New York, N.Y.

[22] Filed: Oct. 31, 1974

[21] Appl. No.: 519,445

[52] U.S. Cl. ..... 110/104 R; 431/202
[51] Int. Cl.[2] ..... F23K 3/02
[58] Field of Search ..... 110/104, 106; 431/202

[56] References Cited

UNITED STATES PATENTS

| | | | |
|---|---|---|---|
| 1,370,872 | 3/1921 | Amsler | 110/104 R |
| 1,595,151 | 8/1926 | Grindle | 110/104 R |
| 2,053,340 | 9/1936 | Kennedy | 110/104 R |

*Primary Examiner*—Edward G. Favors
*Attorney, Agent, or Firm*—Joseph M. Maguire; Robert J. Edwards

[57] ABSTRACT

An improved conduit for conveying fuel from supply to burner means and including a rigid floor disposed therebelow with a covered trench formed therein, the latter defining at least a portion of the conduit.

3 Claims, 5 Drawing Figures

FUEL CONDUIT

BACKGROUND OF THE INVENTION

The invention relates to solid fuel firing and more particularly to a space saving conduit for conveying fuel.

The coal to be fired with a vapor generator has to be conditioned before delivery to the burners, which includes comminuting the fuel to a size compatible with the type of burners being used. The comminutors are normally located in the vicinity of other power plant auxiliaries, e.g., condensers, pumps, fans, feedwater heaters, etc.; this concentration of relatively large apparatus will often create a space availability problem which is further aggravated by the requirement of large diameter piping for conveying comminuted fuel to the burners and by the supporting and bracing structure associated with this piping.

SUMMARY OF THE INVENTION

Accordingly, there is provided a fuel conveying conduit having an intermediate segment which is a trench generally spanning the straight-line distance between the comminuting and burner means, and formed as part of the concrete flooring situated therebelow. The trench includes a top inlet and outlet opening at opposite ends thereof, and is covered by pressure-tight plate means disposed therebetween. The inner periphery of the covered trench is lined with wear resistant replaceable plate members. The fuel conveying conduit includes an inlet and an outlet segment, the former comprising relatively short pipe means flow connecting the comminuting means outlet with the trench inlet, and the latter comprising vertically oriented pipe means flow connecting the trench outlet with the burner means. The trench covering plate means include deck plate means which lie generally flush with the floor and provide an unencumbered walk area.

DESCRIPTION OF THE PREFERRED EMBODIMENT

Figure 1:
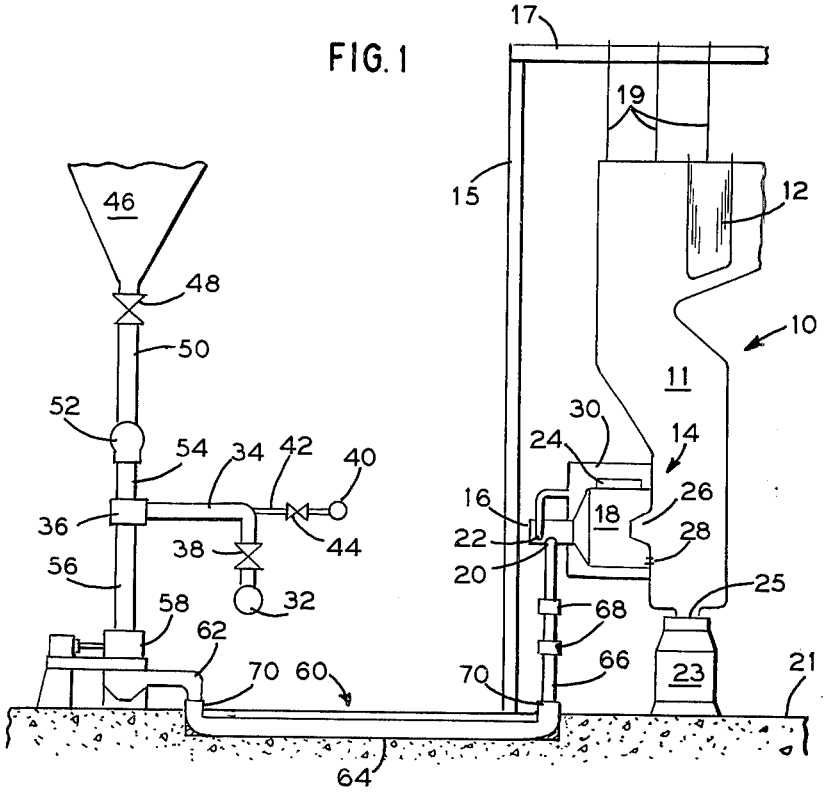
FIG. 1 is a diagramatic sectional side view of the vapor generating facility embodying the invention.
Figure 3:
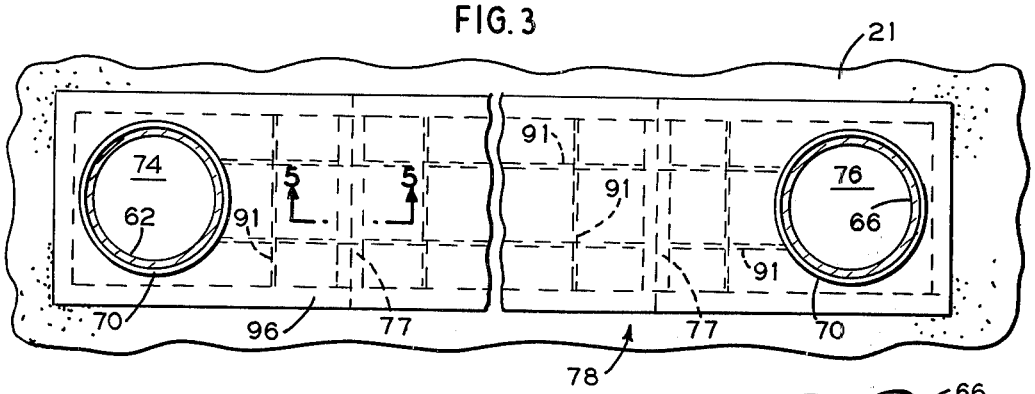
FIG. 3 is a plan view of the trench shown in FIG. 2.
Figure 2:
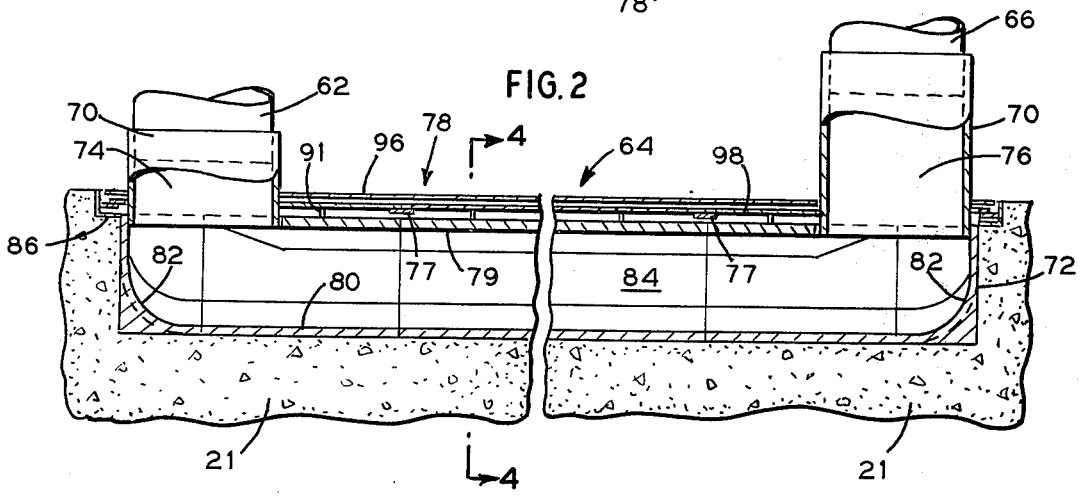
FIG. 2 is a sectional side view of the trench embodied in the invention.
Figure 4:
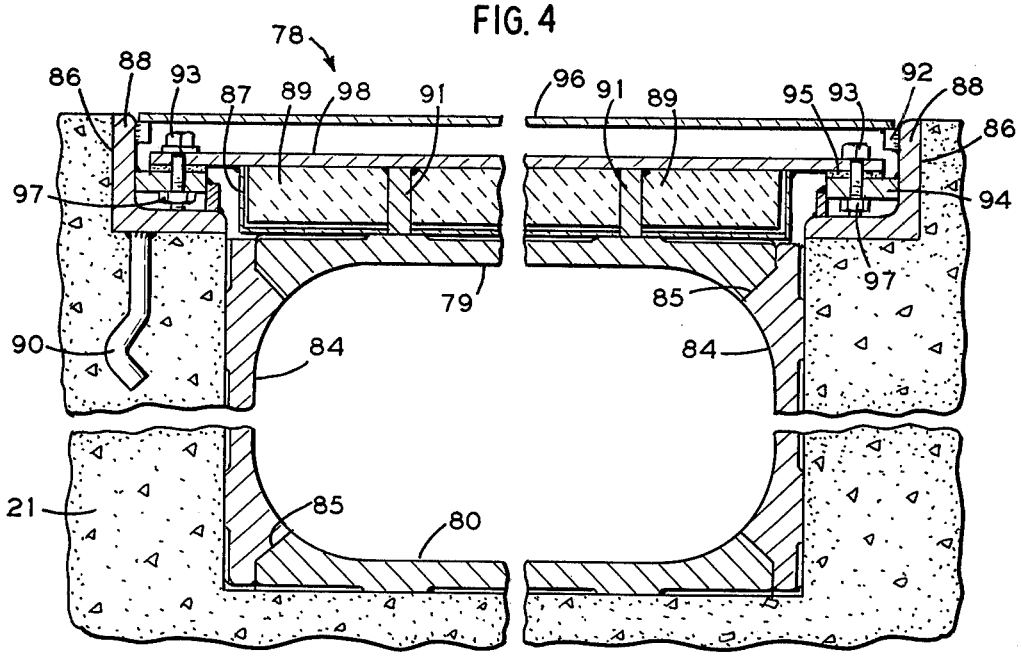
FIG. 4 is a sectional view taken along line 4—4 of FIG. 2.
Figure 5:
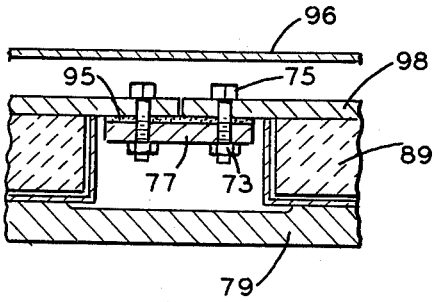
FIG. 5 is a sectional view taken along line 5—5 of FIG. 3.

Referring to FIG. 1, there is shown a portion of a vapor generating and superheating unit 10 including a furnace 11, a pendant superheater 12, and a coal fired cyclone type combustion chamber 14. The vapor generating and superheating unit 10 is top-supported by structural steel members such as upright column 15 and cross beam 17. The support for the unit is provided by a plurality of hangers 19 extending downwardly from the beam 17 and attaching rigidly to the furnace roof. The weight of the vapor generating and superheating unit 10 is transmitted through the hangers, beams and columns to the floor 21 which is formed of concrete and generally serves as the power plant basement floor. The vapor generating and superheating unit

10 is fixed at the hanger connections with respect to thermal growth and expands downwardly and laterally as it is heated to operating temperature.

The cyclone combustion chamber 14 includes a scroll and a barrel section 16 and 18, both being of substantially circular cross section. The scroll section 16 is smaller in diameter than the contiguous barrel section 18 and is positioned at the front end of the cyclone chamber 14 to discharge concentrically into the barrel 18. The scroll section 16 is provided with inlets 20 and 22 for the tangential introduction of primary and tertiary air, the former having the added function of conveying the comminuted fuel to the cyclone combustion chamber 14 as will be hereinafter described. The barrel section 18 has a refractory lined inner periphery backed by fluid cooled tubes and includes an inlet 24 for the tangential introduction of secondary air. The rear end of cyclone chamber 14 is partly closed by fluid cooled tubes and includes a combustion gas outlet 26 in the form of a re-entrant throat arranged therein concentric with the barrel section 18. A slag outlet 28 is disposed below the gas outlet 26 for the discharge of molten slag from the barrel section 18 to the furnace 11 which, in turn, discharges the slag through a bottom tap 25 into a slag tank 23 situated therebeneath.

The following is a preferred distribution of the combustion air being delivered to the vapor generating and superheating unit 10 and taken as a percentage of the total air flow required for a cyclone combustion chamber operating at maximum capacity; 85–90 percent as secondary air, 15–20 percent as primary air and 5 percent as tertiary air. Furthermore, the primary air has a minimum flow limit which insures that air provided in this manner will have sufficient velocity at all loads to achieve a thorough sweeping of the comminutor and fuel conduit means leading to the combustion chamber.

The combustion air is supplied by one or more forced draft fans (not shown) which raise it to super-atmospheric pressure, and is thereafter heated by one or more air preheaters (not shown). A major portion of the combustion air is conveyed to a windbox 30 to be distributed among the secondary and tertiary inlets of the respective cyclone combustion chambers. Dampers (not shown) are associated with the forced draft fans, and the secondary and tertiary inlets to regulate the admission of combustion air therethrough.

An air duct 32 receives preheated primary air at superatmospheric pressure from the air-side outlet of the air preheater (not shown). The air duct 32 discharges into a conduit 34 which opens into a coal-air mixing bustle 36 and includes a flow regulating damper 38. A tempering air duct 40 receives cold air at superatmospheric pressure from the forced draft fan outlet (not shown). A conduit 42 connects the tempering air duct 40 to the conduit 34 and includes a flow regulating damper 44.

The fuel supply includes a bunker 46 arranged to receive and store coal. The outlet end of bunker 46 is provided with a shutoff valve 48 and connects by way of conduit 50 to the inlet end of a drag-link or belt-type controllable feeder 52, the latter discharges through a conduit 54 into the mixing bustle 36. A conduit 56 connects the discharge end of the mixing bustle 36 to the inlet end of a motor drive comminutor 58. A conduit 60 connects the outlet of the comminutor 58 with the inlet 20 of the scroll section 16. The conduit 60 comprises an inlet segment 62, an intermediate segment 64 and an outlet segment 66. The junctures between the intermediate segment 64 and the inlet and outlet segments 62 and 66 are fitted with vertical expansion couplings 70. The outlet segment 66 includes a pair of horizontal expansion couplings 68. The expansion couplings are of a type well known in the art and are manufactured by Dresser Mfg. Div. of Dresser Industries, Inc. The couplings accommodate the thermal growth of metal parts associated with the coal piping and vapor generator as the unit is brought up to operating temperature.

Referring to FIGS. 2, 3, 4 and 5, and in accordance with the preferred embodiment, the intermediate segment 64 is in the form of a trench 72 built into the concrete floor 21. The trench 72 is of generally rectangular cross section and has its longitudinal extent lying along a substantially horizontal plane and includes an inlet and outlet opening 74 and 76 located at opposite ends thereof and a cover plate assembly 78 disposed therebetween. The inner periphery of the trench 72 is protected by wear resistant liners comprised of upper and lower wear plates 79 and 80, end wear plates 82 and side wear plates 84. A ledge 86 extends along the upper periphery of trench 72 and is lined with angle plates 88 which are fixedly attached thereto by anchor pins 90 embedded in the concrete floor 21. A pair of laterally projecting flanges 92 and 94 are weldably connected to the angle plates 88 and act as support members for cover plate assembly 78, the latter including one or more deck plates 96 and pressure cover plates 98.

The deck plate 96 rests on flanges 92 and has its upper surface lying generally flush with the floor level. The cover plates 98 are arranged in end-abutting fashion and joined to one another by junction plates 77 located therebeneath and connected thereto by threadably engaged bolts 75 and lock nuts 73, the latter being weldably fixed to the underside of junction plates 77. The joined cover plates 98 are attached to flanges 94 by threadably engaged bolts 93 and lock nuts 97, the latter being weldably fixed to the underside of flanges 94. Copper wire reinforced asbestos gaskets 95 are inserted between the cover plates 98 and flanges 94 and junction plates 77. The bolt and gasket attachment effects a pressure-tight and dust-proof closure over the trench 72 while at the same time allowing for periodic removal of the cover plates 98 to facilitate inspection, cleaning and repair of the trench 72 and the wear-resistant liners associated therewith. The underside of each cover plate 98 includes longitudinal and transverse rib plates 91 weldably connected thereto and extending downwardly therefrom to bear upon the upper wear plate 79 located therebeneath. Block insulation 89 lines the underside of cover plate 98 to insulate the cover plate assembly 78 from the heat of the primary air and fuel mixture passing through the trench 72. The block insulation 89 is held in place by retainer casing 87.

The upper, lower and side wear plates are formed with angular side surfaces 85 shaped so that side-adjacent wear plates interlock with one another to line the inner periphery of trench 72. Each set of interlocked upper, lower and side wear plates end-abuts an adjoining set. The wear plates are fixedly secured by tightening the bolts 93 thereby exerting pressure through the rib plates 91 onto the upper wear plate 79 which locks into the side wear plates 84, the latter, in turn, interlocking with the lower wear plate 80. Each of the end wear plates 82 is preferably or unitary construction and is fixedly secured in the trench 72 by being inserted between the end faces of the respective outboard wear plate sets and the adjacent expansion coupling 70. An appropriate sealant is applied to the interlocking and abutting sides at the time of assembly. The wear surfaces of the upper, lower, side and end wear plates include arcuate segments formed to provide rounded corners when the plates are assembled thereby inhibiting the settling of coal and promoting the flow of the coal-air mixture through the lined trench 72.

In the operation of the preferred embodiment, heated primary air is supplied by the duct 32 and is tempered to the desired temperature with cold air supplied by the duct 40. The tempered primary air is introduced into the bustle 36 to mix with the coal being discharged from the feeder 52. The primary air conveys the coal to a comminutor 58 wherein the fuel is comminuted to the desired size and is thereafter discharged into the inlet segment 62 of the conduit 60 and is passed through the intermediate segment 64 and through the outlet segment 66 for discharge into the combustion chamber 14 through the scroll inlet 20.

While in accordance with the provisions of the statutes there is illustrated and described herein a specific embodiment of the invention, those skilled in the art will understand that changes may be made in the form of the invention covered by the claims, and that certain features of the invention may sometimes be used to advantage without a corresponding use of the other features.

The embodiments of the invention in which an exclusive property or privilege is claimed are defined as follows:

1. In combination with a fuel firing system comprising fuel supply and burner means spaced from one another, conduit means for conveying the fuel from the supply to the burner means, a rigid floor disposed below said supply and burner means, the floor being formed with trench means defining at least a portion of said conduit means, and said trench means being covered by detachable plate means.

2. The combination according to claim 1 including replaceable wear plate means lining said trench means.

3. The combination according to claim 1 including insulating means lining said detachable plate means.

* * * * *